US005337922A

United States Patent [19]

Salkeld et al.

[11] Patent Number: 5,337,922

[45] Date of Patent: Aug. 16, 1994

[54] APPARATUS FOR DISPENSING LIQUID FROM AN INVERTED CONTAINER

[75] Inventors: Paul Salkeld, Redditch; Andrew Gibbs, Leamington Spa; Robert Tansley, Stratford-upon-Avon, all of England

[73] Assignee: EBAC Limited, United Kingdom

[21] Appl. No.: 96,228

[22] Filed: Jul. 26, 1993

[30] Foreign Application Priority Data

Jul. 17, 1992 [GB] United Kingdom ..... 9215275.0

[51] Int. Cl.[5] ..... B67D 5/56

[52] U.S. Cl. ..... 222/129; 222/88; 222/185; 251/149.3; 141/330

[58] Field of Search ..... 222/83.5, 129, 185, 222/88; 137/317, 846, 847; 141/321, 330, 363, 367, 329; 251/149.3

[56] References Cited

U.S. PATENT DOCUMENTS

| | | | |
|---|---|---|---|
| 811,811 | 2/1906 | Allison | 251/149.3 X |
| 991,725 | 5/1911 | Kennedy | 251/149.3 X |
| 1,241,352 | 9/1917 | Doering et al. | 222/88 |
| 1,933,192 | 10/1933 | Taylor | 222/88 |
| 2,070,488 | 2/1937 | McIntosh | 222/88 |
| 2,259,863 | 10/1941 | Smith, Jr. | 222/88 |
| 4,597,509 | 7/1986 | Pereira | 222/129 |
| 4,699,188 | 10/1987 | Baker et al. | 141/18 |
| 4,805,808 | 2/1989 | Larson | 222/185 |
| 4,834,267 | 5/1989 | Schroer et al. | 222/185 |
| 4,881,661 | 11/1989 | Jones | 222/185 X |
| 5,222,530 | 6/1993 | Baker et al. | 141/330 X |
| 5,232,125 | 8/1993 | Adams | 222/83.5 |

FOREIGN PATENT DOCUMENTS

WO9003919 4/1990 PCT Int'l Appl. .

*Primary Examiner*—Gregory L. Huson
*Attorney, Agent, or Firm*—Ira S. Dorman

[57] ABSTRACT

The apparatus is intended for dispensing liquid from an inverted container having a neck through which the liquid is discharged, and includes a housing 31 provided with a mounting arrangement 32 for receiving and supporting the inverted container. A feed tube 34 is arranged to project into the neck of said liquid container to conduct liquid to a reservoir, and cover flaps 62 and 63 are biassed together by tension springs 69 and 70 to cover the feed tube 34 upon removal of the liquid container. The feed tube may alternatively be covered by a resilient diaphragm.

6 Claims, 2 Drawing Sheets

APPARATUS FOR DISPENSING LIQUID FROM AN INVERTED CONTAINER

TECHNICAL FIELD OF THE INVENTION

This invention relates to liquid dispensers such as bottled water dispensers.

BACKGROUND OF THE INVENTION

Bottled water dispensers are usually arranged to receive the neck of an inverted bottle filled with clean water. Sometimes, as in U.S. Pat. No. 4 699 188 and WO 90/03919 for example, the bottle is provided with a cap through which a feed tube is inserted to discharge the water from the bottle. When the bottle is removed the feed tube remains projecting upwards, fully exposed, ready to receive a fresh bottle.

There is currently a requirement to maintain strict hygiene in water dispensers, and an aim of the present invention may be viewed as being to improve the hygiene of such dispensers.

SUMMARY OF THE INVENTION

The present invention proposes liquid dispensing apparatus which is distinguished by the provision of cover means which is brought into operation to cover the feed tube by removal of the liquid container from the mounting arrangement.

Thus, whenever the container is removed from the apparatus the feed tube will automatically be protected against contamination.

It would be possible, within the scope of the invention, to arrange for the feed tube to be withdrawn or otherwise moved into a position where it is protected by the cover means. Usually, however, the cover means will be moveable whilst the feed tube remains fixed.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE PREFERRED AND ILLUSTRATED EMBODIMENTS

Figure 1:
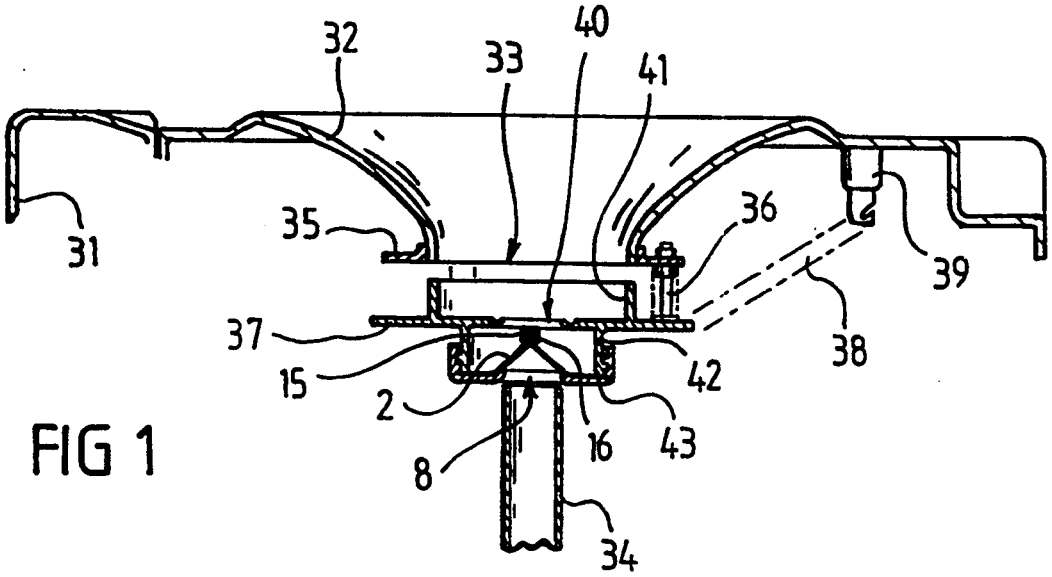
FIG. 1 is a vertical section through a first form of water dispenser of the invention, without a water bottle fitted.

Referring firstly to FIG. 1, the dispenser includes a housing 31 (only the top portion of which is shown) which defines a generally funnel-shaped mounting portion 32 in its top wall for receiving and supporting an inverted water bottle. The mounting portion 32 leads downwardly to a central circular opening 33 for receiving the neck of the water bottle, and a fixed feed tube 34 projects axially upwards towards the centre of the opening 33, but some distance below it. The feed tube 34 leads via suitable pipework (not shown) to a water reservoir in which water may be cooled, heated or carbonated for example, and from which the water can be subsequently discharged via a suitable tap.

Figure 2:
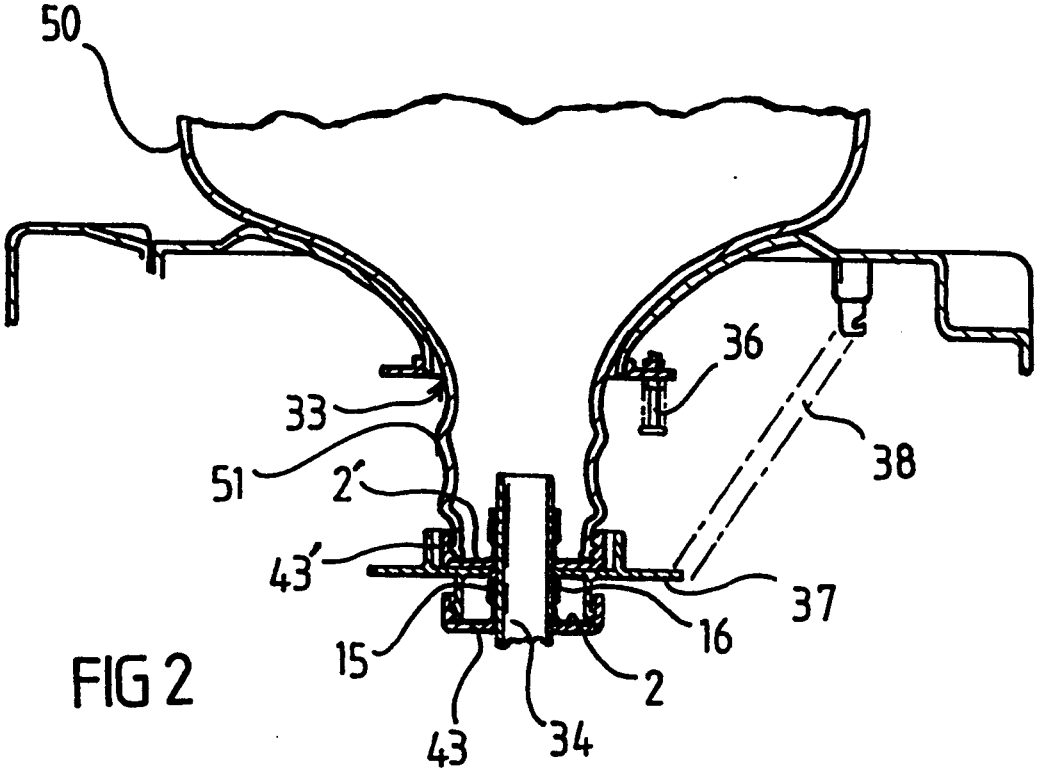
FIG. 2 is a similar sectional view to FIG. 1 but showing a water bottle in place.

The opening 33 is surrounded by an outwardly projecting flange 35 on which several (typically three) downwardly projecting spring-loaded buffers 36 are mounted. A carrier plate 37 is suspended below the opening 33 by tension springs 38 (only one of which is shown) which are anchored to mounts 39 secured to the top wall of the housing 31. The springs 39 thus act to urge the carrier plate 37 upwardly against the buffers 36. The plate 3 7 contains a central opening 40 which is surrounded by an upwardly projecting short cylindrical side wall 41, of about the same diameter as the opening 33. 0n the underside of the plate 37 a further cylindrical wall 42, of smaller diameter than wall 41, surrounds the opening 40. This lower wall 42 carries an external screw thread for engagement with a cap 43, which contains a central circular opening 8 for receiving the feed tube 34. A circular diaphragm element 2, which may be .of rubber or similar resilient material, is held between the end of the wall 42 and the cap 43. The central region of the element 2 is provided with a pair of closely opposed sealing beads 15 and 16, which are joined at their ends to define a slit-shaped opening. Normally, the sealing beads 15, 16 are held in mutual contact due to the natural resilience of the element 2, so that the feed tube 34 is covered by the diaphragm element 2 and cover plate 37. However, when a bottle 50 is fitted to the dispenser as shown in FIG. 2, the neck 51 of the bottle is inserted into the aperture 33. The neck may be fitted with a cap 43′ and diaphragm element 2′ similar to the cap 43 and element 2, or any other suitable closure. As the neck 51 moves downwards through the aperture 33 it comes into contact with the cover plate 37 and then moves the cover plate downwards against the action of the springs 38. The feed tube 34 thus enters the aperture 8 and urges apart the sealing beads 15 and 16 deforming them into a circular configuration before passing through the aperture 40. Further downward movement of the bottle causes the feed tube 34 to sealably enter the neck of the bottle.

When the bottle requires replacement the neck 51 is withdrawn from the opening 33 so that the cover plate 37 moves upwards under the action of springs 38, and the feed tube is withdrawn from the cap 43 allowing the sealing beads 15, 16 to move back into mutual sealing contact above the feed tube 34. There is therefore a reduced risk of contamination of the feed tube 34 when there is no bottle fitted.

It will be appreciated that the opening 8 and 40 for receiving the feed tube 34 need not necessarily be circular as shown. They could be elliptical for example, with the feed tube being of corresponding transverse section.

Figure 3:
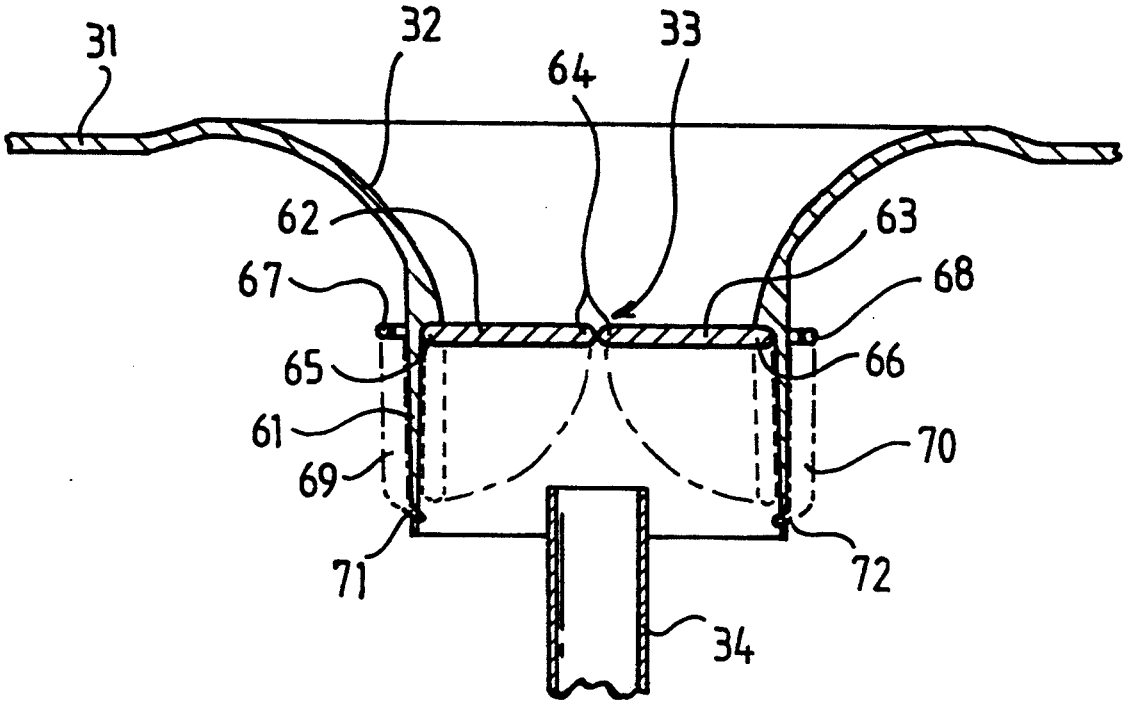
FIG. 3 is a vertical section through a second form of water dispenser of the invention, without a water bottle fitted.

FIG. 3 shows an alternative form of cover arrangement for the feed tube 34 which employs fewer moving parts. In FIG. 3, parts which correspond to those of FIGS. 1 and 2 have been given similar reference numerals. The funnel-shaped bottle-support portion 32 is modified below the circular opening 33 to lead into a downwardly extending sleeve 61. The sleeve may be of rectangular or any other suitable transverse section, and, as shown, surrounds the upper end of the feed tube 34. The flange 35 and plate 37 have been omitted together with the cap 43 and diaphragm element 2. Instead, a pair of opposed cover flaps 62 and 63 are mounted within the sleeve 61 to meet closely at their inner edges 64 in a generally co-planar configuration. The flaps are pivotally mounted at their outer edges 65 and 66 such that they can be pivoted apart and moved to a downward position, as indicated in dotted outline, lying against the sides of the sleeve 61. Anchor pins 67 and 68 project from the outer edges 65 and 66 through the sleeve 61, and tension springs 69 and 70 or other suitable biassing means are provided to act between the respective pins 67 and 68 and further anchorage points 71 and 72 at the lower end of the sleeve 61. These springs thus urge the flaps into a normal co-planar position as illustrated, to abut the underside of the circular funnel-shaped portion 32. Insertion of the neck of a water bottle between the flaps moves them apart as described, allowing the neck to be inserted over the feed tube 34. Withdrawal of the bottle neck allows the flaps to move together again under the action of springs 69 and 70, and cover the feed tube 34, as shown.

Again, the flaps 62 and 63 may be mounted on a movable carrier plate which is moved over the feed tube 34 by the neck of the bottle, and such movement of the carrier plate in turn causes the flaps to be moved apart, either by the feed tube itself or by another suitable mechanism.

Having thus described the invention, what is claimed is:

1. Liquid dispensing apparatus for dispensing liquid from an inverted container having a neck through which the liquid is discharged, the apparatus comprising:

a housing provided with a mounting arrangement for receiving and supporting the inverted container thereon, said mounting arrangement defining an opening for receiving the bottle neck;

a dischargeable liquid reservoir mounted within said housing;

a feed tube arranged to project upwardly to a level adjacent said opening for being received in the neck of the inverted container, to conduct liquid therefrom to said reservoir, said feed tube having an upper end portion containing a liquid inlet aperture; and cover means mounted in association with said opening for movement between a first position in which said upper end portion of said feed tube is exposed for reception in the neck of the container, and a second position in which said upper end portion of said feed tube is isolated from said opening of said mounting arrangement by said cover means, whereby said feed tube is protected automatically against contamination when the container is removed from said mounting arrangement.

2. Apparatus according to claim 6, in which said cover means comprises first and second, mutually displaceable cover portions that are proximately disposed in said first position of said cover means and are separated from one another in said second position thereof, and in which said biasing means biases said cover portions together in said first position, to cover said feed tube portion.

3. Apparatus according to claim 2, in which said cover portions comprise pivotally mounted flaps.

4. Apparatus according to claim 2, in which said feed tube is fixed in position.

5. Apparatus according to claim 2, in which said cover portions are arranged to be moved apart against the action of said biasing means by the neck of the container when the neck is inserted into said opening.

6. Apparatus according to claim 1, further including means for biasing said cover means towards said second position.

* * * * *

UNITED STATES PATENT AND TRADEMARK OFFICE

CERTIFICATE OF CORRECTION

PATENT NO. : 5,337,922

DATED : August 16, 1994

INVENTOR(S) : Paul Salkeld, Andrew Gibbs and Robert Tansley

It is certified that error appears in the above-identified patent and that said Letters Patent is hereby corrected as shown below:

Claim 2, column 4, line 18, delete the word "first" and substitute therefor --second--. Same claim, line 19, delete the word "second" and substitute therefor --first--.

Signed and Sealed this

Twenty-first Day of May, 1996

Bruce Lehman

*Attest:*

BRUCE LEHMAN

*Attesting Officer*

*Commissioner of Patents and Trademarks*